US005772183A

United States Patent [19]

Sears

[11] Patent Number: 5,772,183

[45] Date of Patent: Jun. 30, 1998

[54] PORTABLE LIFTING APPARATUS FOR DEMOUNTABLE POSITIONING IN AN OVERHEAD LOCATION

[76] Inventor: Michael R. Sears, 22210 Acorn Valley Dr., Spring, Tex. 77389-4798

[21] Appl. No.: 626,025

[22] Filed: Apr. 1, 1996

[51] Int. Cl.[6] ..... B66D 1/00

[52] U.S. Cl. ..... 254/324; 254/323; 248/333

[58] Field of Search ..... 254/324, 334, 254/338, 335, 336, 323; 248/332, 333

[56] References Cited

U.S. PATENT DOCUMENTS

| | | | |
|---|---|---|---|
| 462,875 | 11/1891 | Huff | 254/334 X |
| 685,764 | 11/1901 | Hood | 254/324 |
| 2,642,198 | 6/1953 | German | 254/338 X |
| 2,713,609 | 7/1955 | Niklason | 248/333 X |
| 3,300,186 | 1/1967 | Lee | 254/334 |
| 4,576,251 | 3/1986 | Matsuura et al. | 182/152 |
| 4,928,927 | 5/1990 | Frederick et al. | 254/324 X |
| 4,941,645 | 7/1990 | Hall | 254/338 X |
| 4,962,913 | 10/1990 | Stewart | 254/324 X |
| 5,263,687 | 11/1993 | Garbiso | 254/334 |

*Primary Examiner*—Daniel P. Stodola
*Assistant Examiner*—Emmanuel M. Marcelo

[57] ABSTRACT

A lifting apparatus including a beam assembly, a lifter affixed to a surface of the beam assembly for lifting weighted objects toward or away from the beam assembly, a cable extending from the lifter, a first leg pivotally connected to one side of the lifter on the beam assembly and a second leg pivotally connected to an opposite side of the lifter on the beam assembly. The first and second legs are pivotally movable between a first position in parallel relationship to the beam assembly and a second position perpendicular to the beam assembly. Each of the first and second legs has a foot member affixed thereto opposite the beam assembly. The beam assembly includes a first beam member and a second beam member in spaced parallel relationship to the first beam member. Each of the first and second legs also includes a bracket member which is detachably affixed to the first and second beam members, a first leg portion pivotally connected to the bracket member and a second leg portion in telescoping relationship to the first leg portion. The distance between the legs is adjustable along the length of the beam assembly. The length of each of the legs is adjustable by extending or retracting one leg portion with respect to the other leg portion.

16 Claims, 5 Drawing Sheets

PORTABLE LIFTING APPARATUS FOR DEMOUNTABLE POSITIONING IN AN OVERHEAD LOCATION

TECHNICAL FIELD

The present invention relates to self-contained, portable, and adjustable lift devices. More particularly, the present invention relates to lifting devices which are used to lift loads into upper spaces from lower spaces and vice versa. More particularly, the present invention relates to lifting devices that are used to lift objects at ground level for removal, display, or for repair.

BACKGROUND ART

Heretofore, various lifting devices have been employed for the purpose of lifting weighted objects from one place to another. Typically, cranes, and similar objects, have been employed in a commercial sense for the moving of large objects. Additionally, various portable lifting devices have been devised to lift and suspend loads. Fortunately, none of these devices have had specific application in attics or upper spaces that fit on structural members near a pull down stairway or opening and also provide for load control and manipulation.

In the past, various patents have issued from various lifting devices. U.S. Pat. No. 5,320,316 discloses a tripod stand that is vertically adjustable that may potentially support loads above or below it in typical fashion. U.S. Pat. No. 4,103,757 is a device that is adjustable to lift objects using a hydraulic cylinder in a vertical and horizontal manner. It does not go in such spaces as attics, etc., but is set up as a tripod with a bucket attached. U.S. Pat. No. 5,322,403 discloses a device for moving heavy loads with a jacking mechanism. Its support is on top and does not support loads underneath. U.S. Pat. No. 5,303,941 discloses a mobile tripod support device for support of heavy equipment. It is mobile but not adjustable vertically. U.S. Pat. No. 4,705,251 discloses a support for holding heavy objects but does not provide for lifting of a load. U.S. Pat. No. 4,576,251 reveals a scaffold device that is unfolded by pivoting two legs and a cross bar assembly. This apparatus has no allowance for attachment to other structural members and no provision for lifting loads. U.S. Pat. No. 4,309,010 discloses an adjustable tripod for load support. No provision is made for load control or lifting. U.S. Pat. No. 658,810 discloses a folding hoist that has a trolley device attached and folds, but cannot stand on its own and requires cables and clamps to stabilize it. It also does not provide for width and height adjustments. U.S. Pat. No. 471,468 shows a hoisting apparatus that lifts objects onto structures but does not sit over a space, does not have height or width adjustments, and is not able to stand on its own with a load attached without substantial anchoring of support legs. U.S. Pat. No. 2,863,569 shows a portable lifting device that must be assembled and disassembled when used and moved. It also cannot stand on its own, fold inwardly upon itself, or straddle an opening to lift a load. U.S. Pat. No. 1,775,398 discloses a lifting device that fits through a window to lift objects and trolley them through the window. U.S. Pat. No. 980,330 discloses a hoisting device that fits in a window opening or other similar opening and pivots. It is not able to stand on its own, and is not adjustable for height or width, or does not have legs that fold inward upon themselves. U.S. Pat. No. 1,646,133 is a hoisting derrick that is similar to the one above just described. Soviet Union Patent No. 91-199624 is a crane for use on buildings. This device lifts objects outside of the building and brings the load up and into a window or opening. It does not straddle a load, nor stand on its own, nor fold in inwardly upon itself.

These and other known load lifting apparatus are useful but none provide for convenient setup in small spaces, such as attics or on structural members of varying dimensions and distances apart.

It is an object of the present invention to provide a device that is physically small, folds up and unfolds.

It is another object of the present invention to provide a device that is light weight.

It is still another object of the present invention to provide a device that is low cost.

It is a further object of the present invention to provide a device that is easy to manufacture.

It is another object of the present invention to provide a device that is extremely strong and stable, when resting on structural members or standing alone or when partially supported by a ladder.

It is still another object of the present invention to provide a device that will lift 100% of a heavy load.

It is a further object of the present invention to provide a device that can be easily manipulated, set up, taken down, and worked with a heavy load on it, by one person.

It is still another object of the present invention to provide a device that is adjustable in width and height.

It is a further object of the present invention to provide a device that is a safe working platform and that transfers the weight of loads to structural members.

It is another object of the present invention to provide a device that may be operated by one person.

It is still another object of the present invention to provide a device that so greatly increases safety of worker and equipment so as to decrease liabilities and injuries.

It is a further object of the present invention to provide a device to keep excessive loads off of pull down stairways or similar structures.

It is another object of the present invention to provide a device to lift compressors out of condensing units, lift loads out of trucks, and other similar jobs, while being able to roll loads to or from a site.

It is still another object of the present invention to provide a device that is needed and has a definite niche and satisfies an existing, recognized need. Presently, there is no device manufactured that fills this niche.

It is a further object of the present invention to provide a device that has a long life.

It is still another object of the present invention to provide a device that has less product liability and less home and business owner liability, due to increased safety, simplicity, strength, and decreased weight.

It is a further object of the present invention to provide a device that can be set up in attics or similar spaces and left set up, to be used by a homeowner to periodically put things in or take things out of their attic or upper space.

It is still another object of the present invention to provide a device that has multiple, portable, foldable, lifting and load moving capabilities that can work in attics or similar spaces or on roofs in conjunction with a ladder or without one.

It is a further object of the present invention to provide a device that makes compliance with OSHA regulations easier or possible.

It is still another object of the present invention to provide a device that can be used in material handling in general construction applications.

It is a further object of the present invention to provide a device with support legs that fold inwardly upon themselves and upon the main support beam to provide a very compact device, when stored or handled.

It is still a further object of the present invention to provide a device that can be set up on terrain and lift objects and roll them to various locations.

It is a further object of the present invention to provide a device that can lift appliances by one person, such as refrigerators and vending machines, lift them, roll them, and put them in or take them out of a vehicle.

These and other objects and advantages of the present invention will become apparent from a reading of the attached specification and appended claims.

SUMMARY OF THE INVENTION

The present invention is a lifting apparatus that comprises a beam assembly, a lifting means affixed to a surface of the beam assembly, a first leg pivotally connected to one side of the lifting member on the beam assembly, and a second leg pivotally connected to an opposite side of the lifting member on the beam assembly. The first and second legs are pivotable between a first position in parallel relationship to the beam assembly and a second position perpendicular to the beam assembly. Each of the first and second legs has a foot member affixed thereto opposite the beam assembly.

The beam assembly includes a first beam member and a second beam member in spaced parallel relationship to the first beam member. The cable of the lifter extends downwardly between the first and second beam members.

Each of the first and second legs includes a bracket member which is affixed to the first and second beam members, a first leg portion pivotally connected to the bracket member, and a second leg portion in telescoping relationship to the first leg portion. A pin member is provided so as to detachably affix the bracket member to the beam assembly so as to adjust the distance between the bracket members and to allow the legs to be moved to their second position. Similarly, a pin member is employed so as to adjust the length of the legs by allowing one of the leg portions to telescope within the other leg portion. Each of the legs is a square tubular member, one of the legs being of greater cross-sectional area than the other leg member.

The foot member of each of the first and second legs includes an angle bar which is affixed to an end of the leg opposite the beam assembly. This angle bar extends transversely to a longitudinal axis of the leg. A plurality of holes are formed in spaced relationship on the bottom surface of the angle bar. At least one stabilizer pin extends through the hole in the angle bar so as to engage an underlying surface.

The lifter of the present invention is a winch having a handle extending outwardly therefrom. The winch has a cable extending around a sheave therein. The handle is rotatable so as to reel the cable outwardly or inwardly. The winch is mounted on a base member which is threadedly secured to a top surface of the beam assembly.

DETAILED DESCRIPTION OF THE INVENTION

Figure 1:
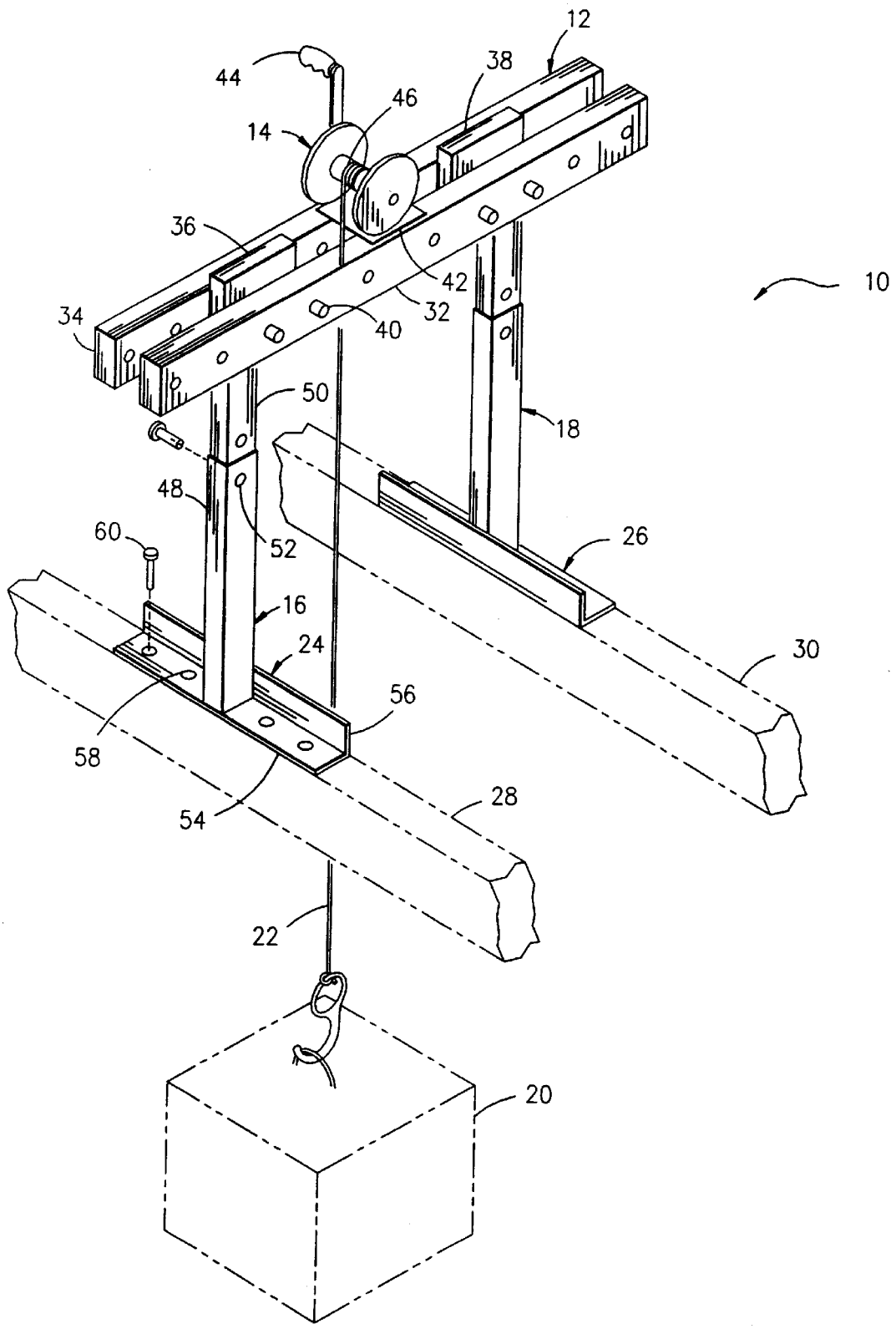
FIG. 1 is an isometric perspective view of the present invention in its unfolded and load lifting position.

Referring to FIG. 1, there is shown at 10 the lifting apparatus in accordance with the teachings of the present invention. The lifting apparatus 10 includes a beam assembly 12, a lifting means 14, a first leg 16 and a second leg 18. As can be seen, the lifting means is a winch which is affixed to a surface of the beam assembly 12. The winch 14 serves to lift a weighted object 20 toward or away from the beam assembly 12. The winch 14 has a cable 22 extending therefrom.

First leg 16 is pivotally connected at one end to the beam assembly 12. As will be described hereinafter, the first leg 16 is pivotable between a first position in parallel relationship to the beam assembly 12 and a second position (as shown in FIG. 1) perpendicular to the beam assembly 12. The first leg 16 has a foot member 24 affixed to an end of the leg 16 opposite the beam assembly 12. The second leg 18 is also pivotally connected to the beam assembly 12 on an opposite side of the lifter 14. The second leg 18 is also pivotable between a first position in parallel relationship to the beam assembly 12 and a second position (as shown in FIG. 1) perpendicular to the beam assembly 12. The second leg 18 has a foot member 26 affixed to an end of the leg 18 opposite the beam assembly 12. In FIG. 1, it can be seen that the foot member 24 is secured to a structural member 28 on an underside of the foot member 24. The foot member 26 is secured to another structural member 30 on the underside of the foot member 26.

In FIG. 1, it can be seen that the beam assembly 12 includes a first beam member 32 and a second beam member 34. Each of the beam members 32 and 34 has a plurality of holes extending in spaced relationship longitudinally therealong. Each of the holes on the first beam member 32 are aligned with holes on the second beam member 34. A bracket 36 is secured between the parallel beam members 32 and 34 so as to allow the first leg member 16 to be attached to the beam assembly 12. A second bracket member 38 is also affixed between the first beam member 32 and the second beam member 34 so as to allow the second leg 18 to be secured between these beam members. Suitable pins 40 extends through the holes of the beam members 32 and 34 so as to affix the brackets 36 and 38 in their proper position along the length of the beam assembly 12. A plurality of holes formed in the beam members 32 and 34 allows each of the brackets 36 and 38 to be adjusted so that the distance between the legs 16 and 18 can be accordingly adjusted.

The lifting means 14 is a winch which is secured to a base 42 on a top surface of the beam assembly 12. The winch 14 has a handle 44 extending outwardly therefrom. The cable 22 is wrapped around a sheave 46 on the interior of the winch 14. A rotation of the handle 44 causes the cable 22 to move upwardly or downwardly. The lifter 14 is a conventional winch which utilizes gears, and other mechanisms, so as to allow the user to lift heavy weights through a simple and easy rotation of the handle 14.

The leg 16 includes a first leg portion 48 and a second leg portion 50. Each of the leg portions are in telescoping relationship. A pin member 52 extends through holes in each of the leg portions 48 and 50 so as to allow for the adjustment of the length of the leg 16. A similar configuration is found for the second leg member 18.

Each of the foot members 24 and 26 is an angle bar having a bottom surface 54 and an upwardly extending flange portion 56. A plurality of holes 58 are formed on the bottom portion 54 of the angle bar of the foot member 24. A stabilizer pin 60 can be inserted into one of the holes 58 so as to affix the foot member 24 to the top surface of the structural member 28. A similar arrangement can be employed for the foot member 26 on the second leg 18.

Figure 2:
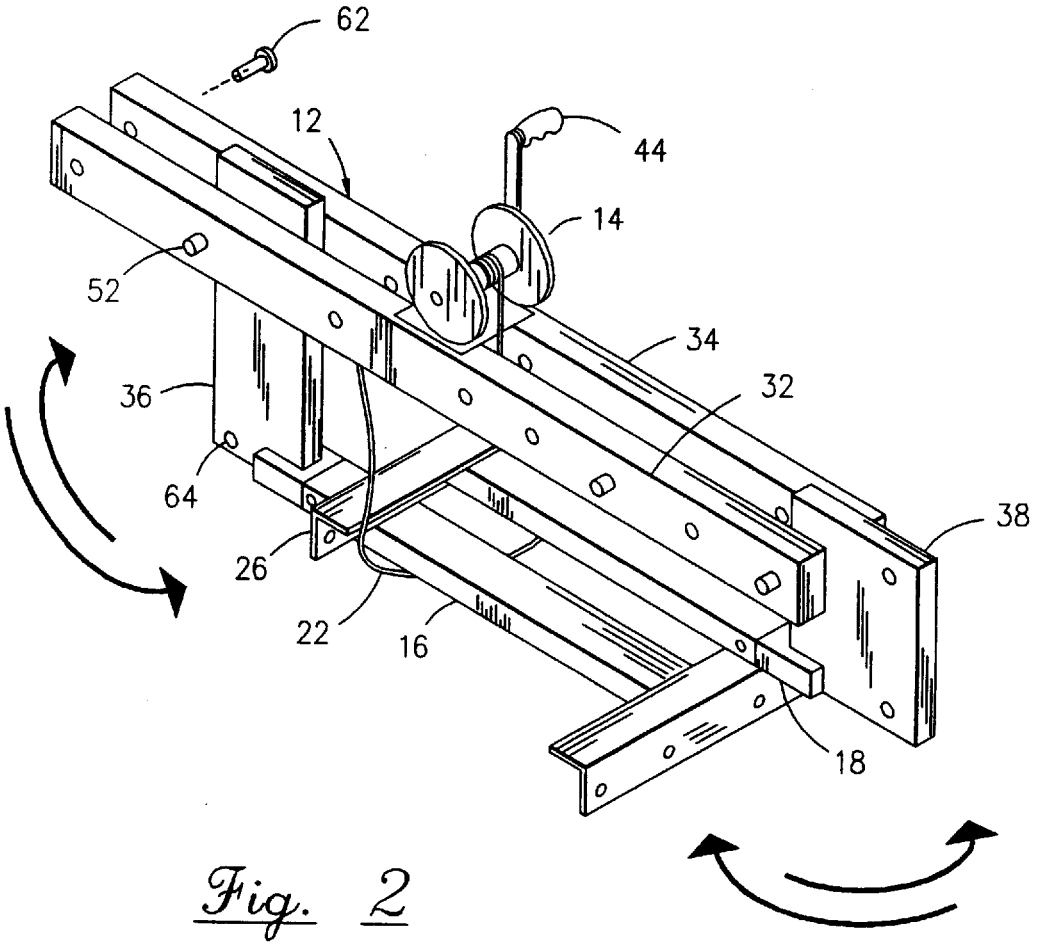
FIG. 2 is a perspective view of the present invention in its folded configuration.

FIG. 2 shows how the lifting apparatus 10 can be disassembled for easy transportation and storage. Initially, it can be seen that the second leg 18 is disassembled by removing pins which serve to secure the bracket member 38 between the first beam member 32 and the second beam member 34. When the pins are removed, the bracket 38 can rotate so as to allow the second leg 18 to rotate to a position in parallel relationship to the beam assembly 12. The foot 26 will reside in close proximity to the underside of the beam assembly 12. If necessary, the telescoping leg 18 can be retracted to its smallest length so as to minimize the area for storage.

The first leg member 16 can also be retracted in a similar manner. It can be seen that the bracket member 36 is rotated by the removal of a pin 62. When the pin 62 is removed from the hole 64, the bracket 36 will rotate so as to allow the second leg 16 to move to its position in parallel relationship to the beam assembly 12. The first leg 16 will reside below the second leg 18. The sizing of the respective brackets 36 and 38 allows for the proper stowage of the first leg 16 relative to the second leg 18. So as to secure the legs together, the cable 22 from the winch 14 can be wrapped around the exterior of the first leg 16 and extended back to the winch 14. By a rotation of the handle 44, the cable 22 can be tightened so as to securely retain the first leg 16 and the second leg 18 in their stowed positions. The removed pins can be placed in a convenient location for future use.

Figure 3A:
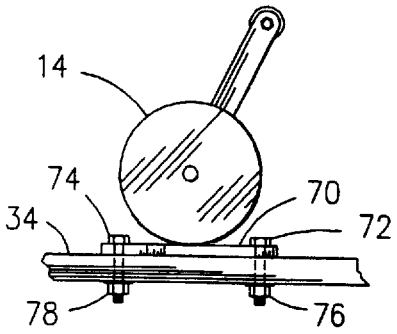
FIG. 3A is a side detail view of the lifting apparatus of the present invention showing, in particular, how it is attached to the beam assembly.

FIG. 3A shows a detailed view of the manner in which the lifting means 14 is secured to the top surface of the beam assembly 12. In particular, it can be seen that the winch of the lifting means 14 is affixed to a base plate 70. The base plate 70 is secured by bolts 72 and 74 through holes in the beam assembly 12. Suitable nuts 76 and 78 can be tightened so as to firmly affix the lifter 14 to the top surface of the beam assembly 12. If needed, the nuts 76 and 78 can be loosened so as to allow for the removal and storage of the ratchet winch 14.

Figure 3B:
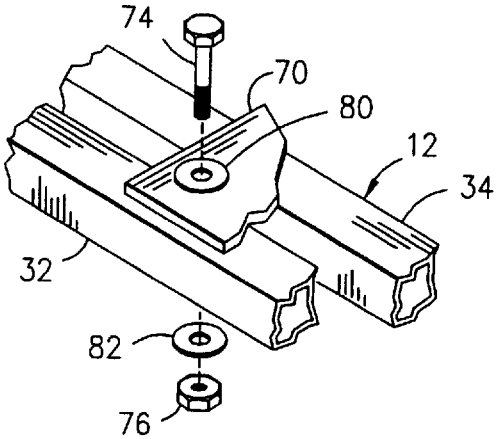
FIG. 3B is a perspective exploded view of the beam assembly used to secure the lifter to the beam assembly.

FIG. 3B shows a detailed view of how the base plate 70 is affixed to the top surface of the beam assembly 12. In particular, it can be seen that the bolt 74 passes through a washer 80 and through a hole in the base plate 70 and will extend between the beam members 32 and 34. The nut 76 can then be threadedly secured to the threaded portion of the bolt 74. Another washer 82 will also extend around the outer diameter of the bolt 74. As the nut 76 is tightened, the base plate 70 will be firmly secured to the top surface of the beam assembly 12.

Figure 4:
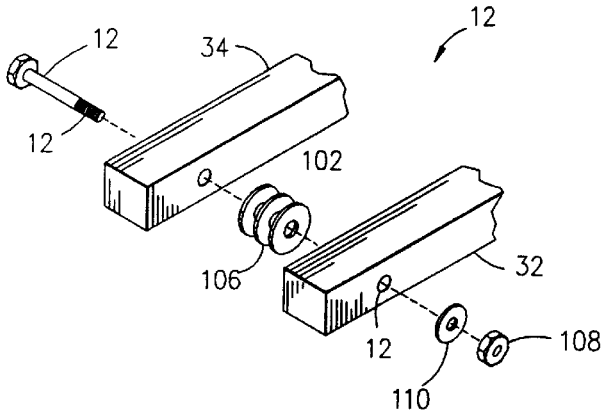
FIG. 4 is an exploded view of the arrangement for connecting the beam assembly together.

FIG. 4 shows how the beam assembly is formed. In particular, it can be seen that the beam assembly 12 has the first beam member 32 and the second beam member 34. A hole 100 extends through the first beam member 32. An aligned hole 102 extends through the second beam member 34. A connecting bolt 104 will extend through hole 102, through spacers 106 and through the hole 100. The beam members 32 and 34 are drawn together by a tightening of a nut 108 along with a washer 110 around the threaded portion 112 of the connecting bolt 104. There is a similar arrangement of holes at an opposite end of the beam assembly 12.

Figure 5:
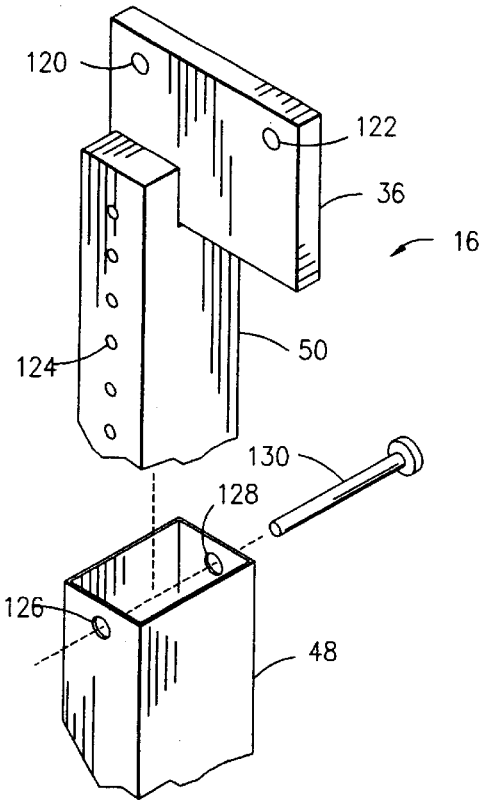
FIG. 5 is a perspective view of the telescoping legs of the present invention.

FIG. 5 is a detailed view of the first leg 16 (or the second leg 18). In FIG. 5, it can be seen that the bracket 26 has a first aperture 120 and a second aperture 122. The apertures 120 and 122 are affixed to the beam assembly by receiving a pin member through the holes 40 of the beam assemblies. The leg 16 includes a first leg portion 50 and a second leg portion 48. It can be seen that the first leg portion 50 includes a plurality of openings 124 formed therein. The openings 124 extend in spaced relationship longitudinally along the length of the first leg portion 50. The first leg portion 50 and the second leg portion 48 are formed of square tubular material. The second leg portion 48 includes a first hole 126 and a second hole 128. The holes 126 and 128 are formed in alignment on opposite walls of the second leg portion 48. The second leg portion 48 will slidingly receive the first leg portion 50 therein. At least one of the leg portions 48 and 50 should be of a smaller cross-sectional area than the other leg portion so as to allow for this easy sliding relationship. When the openings 124 of the first leg portion 50 are aligned with the holes 126 and 128 of the second leg portion 48, a pin member 130 can be inserted therein so as to secure the leg portions 48 and 50 together. In this manner, the length of the leg 16 can be easily adjusted.

Figure 6:
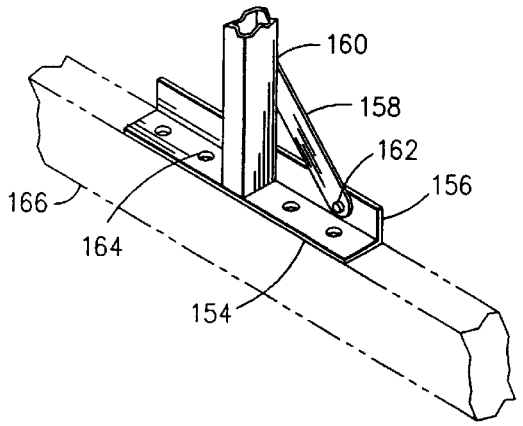
FIG. 6 shows an alternative embodiment of the foot as attached to the leg of the lifting apparatus of the present invention.
Figure 6A:
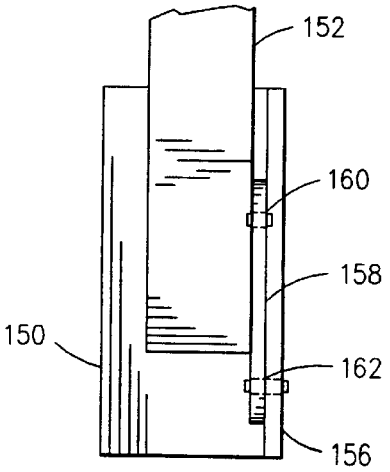
FIG. 6A shows the alternative embodiment of FIG. 6 with the foot member in a second position aligned with the leg.

FIG. 6 shows an alternative embodiment of the arrangement of the foot member 150 at the end of a leg 152. In particular, in this configuration, the foot member 150 is a angle bar having a bottom portion 154 and an upwardly extending flange portion 156. A pivot bar 158 is pivotally connected at end 160 to a surface of the leg 152. An opposite end 162 is pivotally connected to the flange portion 156 of the foot member 150. As can be seen, this pivot bar 158 allows the foot member 150 to be movable between a position (as shown in FIG. 6) transverse to the longitudinal axis of the leg 152. By a rotation and manipulation of the pivot bar 158 and the foot member 150, the foot member 150 can be retracted so as to reside in alignment with the leg 152 (as shown in FIG. 6A). It can be seen that the bottom surface 154 of the foot member 150 includes holes 160 that allow the foot member 150 to be affixed to an underlying surface 166.

Figure 7:
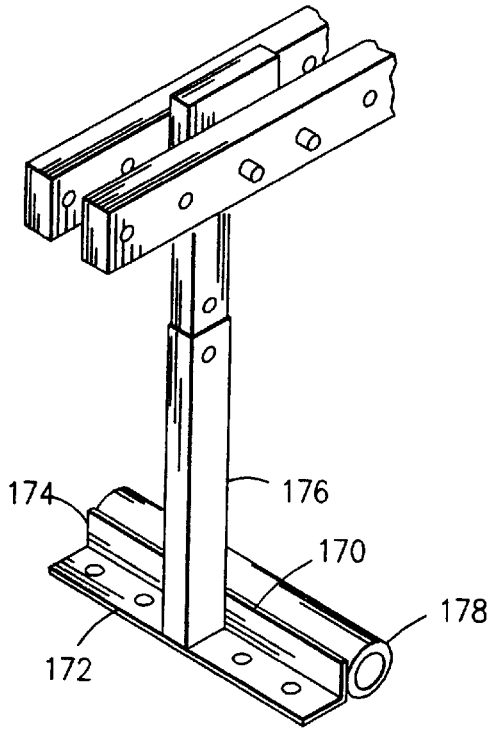
FIG. 7 shows another alternative embodiment of the foot member as attached to the leg of the present invention.

FIG. 7 shows an alternative arrangement of a foot member 170 of the present invention. It can be seen that the foot member 170 is an angle bar having a bottom surface 172 and an upwardly extending flange portion 174. The foot member 170 is rigidly secured to the bottom of leg 176 so as to extend transversely thereto. A tube 178 is affixed to the flange portion 174 of the foot member 170. The tube 178 will also extend transverse to the leg 176. The tube 178 can be attached anywhere on the foot member 170 so as to facilitate attachments such as pins, wheels, or wheel axles through or on the tube 178.

Figure 8B:
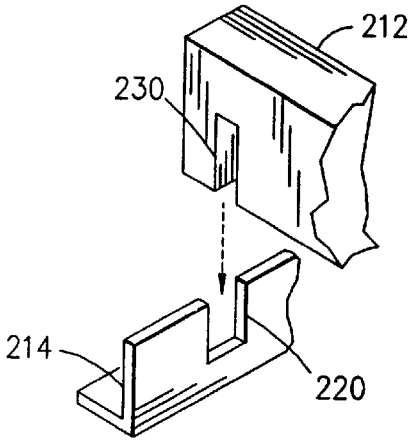
FIG. 8B shows a detailed configuration of the third alternative embodiment of the foot member of FIG. 7.
Figure 8C:
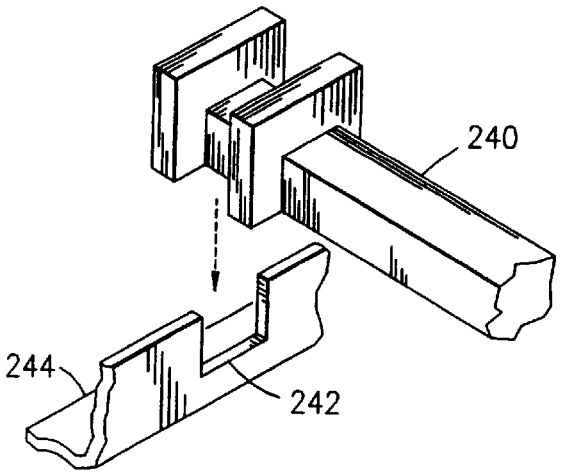
FIG. 8C is another alternative configuration of the foot member of the alternative embodiment of FIG. 7.
Figure 8A:
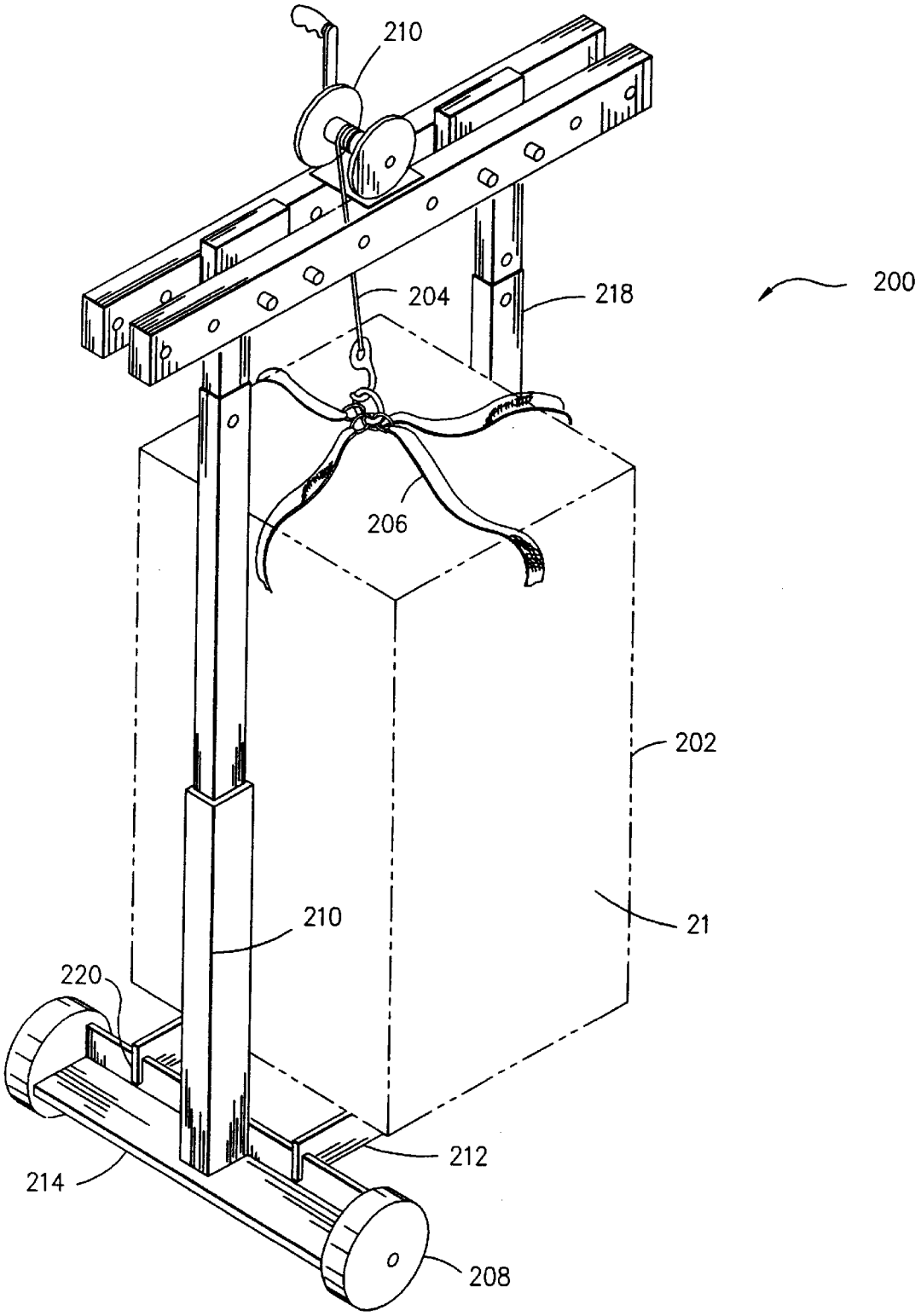
FIG. 8A shows a third cross-section of the foot member as attached to the leg of the present invention.

FIG. 8A shows a perspective view of the lifting apparatus 200 as it fits over an appliance 202. The cable 204 is attached to lift straps 206. The lifting apparatus 200 includes wheels 208 which can be swiveled in order to get into close locations. The appliance 202 is lifted using the cable 204 attached to the lifting mechanism 210. Cross supports 212 are placed under the appliance 202 and across so as to join the foot 214 of the first leg 216 with the corresponding foot of the second leg 218. Each of the feet 214 has notches 220 that match and accept cross notches of the cross support 212 so as to lock them in place. The appliance 202 is then partially rested on these cross supports 212 and partially suspended from the lifter 210 via the cable 204 and the straps 206. This lowers the center of gravity of the lifting apparatus 200 and increases its stability. It also makes transport of the heavy appliance 202 easier and safer. When the lifting apparatus 200 reaches a truck, for example, the legs 216 and 218, which telescope, can be offset so as to lift the appliance 202 into the back of the truck. The cross supports 212 are removed for this operation.

FIG. 8B shows a perspective view of the cross supports 212 with its cross notches 230 as placed over the notch 220 of the foot member 214. It can be seen how the support 212 can fit down into the notch 220, thereby locking the legs 216 and 218 into position. Once the notches 230 and 220 engage each other, the suspended appliance 202 can be lowered.

FIG. 8C shows an alternative embodiment in which a cross tubing 240 is received within a cross notch 242 on a foot member 244. The tubing 240 can extend between the foot members of each of the legs so as to provide similar support.

Accordingly, it can be seen that this device is a multiple use device of great flexibility and can be used in many different applications such as attics, roofs of buildings, upper spaces where loads need to be raised or lowered, moving heavy appliances, construction sites where building materials need to be lifted or lowered, or package and cargo vehicles. It is a device that may also be used in and around shops, warehouses, or work areas to lift, lower, or move loads. In some of the embodiments listed here, this device can be made mobile with wheels to actually move heavy loads across distances. Also this is a simple device to produce and use, while being lightweight, and provides a stable platform of load control in unusual areas heretofore neglected and not having any such device to manipulate loads. This invention also, very easily and quickly, completely folds up onto itself with all components in place and nothing needing removal, for storage or transport. It would not be necessary for a domestic, light, home use model to fold up, but could be rigidly designed. The weight of this invention is extremely light, therefore easily handled by one person. This invention is also adjustable for width and height so as to fit almost any configuration.

Although the description above contains many specificities, these should not be construed as limiting the scope of the invention but as merely providing illustrations of some of the presently preferred embodiments of this invention. Various other embodiments and ramifications are possible within its scope. For example, use of this invention to lift engines out of vehicles and roll them a distance. Another is to lift compressors out of condensing or similar units and to roll them a distance. Another is the ability of this invention is to unequally adjust the legs, to lift objects out of the backs of trucks or vans and put them at ground level for transport, which also can be accomplished by this invention. Another is to lift electric motors, roll them, put them in place, etc. Another is for mail trucks or package trucks to lift heavy packages or cargo and delivering it to an area. This device may be used in rescue operations from extension ladder trucks to raise and lower loads, such as a cage with people inside, rescue personnel, or equipment. This invention could be adapted for use on skyscrapers to lower personnel in an emergency. Use of two units could allow for a large and long load to be manipulated. A still lighter, more inexpensive, non-commercial/industrial version of this invention can be used as a permanent attachment in an attic space in a domestic home for the homeowners' convenience and safety, to safely lift boxes of books, etc., up into or out of attics or similar spaces where things are placed or stored. As mentioned, this model would not necessarily need to fold up or be as adjustable.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A lifting apparatus comprising:

a beam assembly;

a lifting means affixed to a surface of said beam assembly, said lifting means for lifting weighted objects toward or away from said beam assembly, said lifting means having a cable extending therefrom;

a first leg pivotally connected to one side of said lifting means on said beam assembly, said first leg pivotable between a first position in parallel relationship to said beam assembly and a second position perpendicular to said beam assembly, said first leg having a foot member affixed thereto opposite said beam assembly;

a second leg pivotally connected to an opposite side of said lifting means on said beam assembly, said second leg pivotable between a first position in parallel relationship to said beam assembly and a second position perpendicular to said beam assembly, said second leg having a foot member affixed thereto opposite said beam assembly, each of the foot members of said first and second legs comprising:

a transverse beam affixed to an end of the leg opposite the beam assembly, said transverse beam being an angle bar having an upwardly extending flange portion, said flange portion having a notch formed therein; and a pair of wheels rotatably connected to said transverse beam; and a cross support detachably engaging the notch of said flange portion of said angle bar and extending between the foot member of said first leg and the foot member of said second leg in generally parallel relationship to said beam assembly.

2. The lifting apparatus of claim 1, said beam assembly comprising:

a first beam member; and a second beam member in spaced parallel relationship to said first beam member.

3. The lifting apparatus of claim 2, said cable extending downwardly between said first and second beam members.

4. The lifting apparatus of claim 2, said first leg pivotally connected at one end between said first and second beam members, said second leg pivotally connected at one end between said first and second beam members.

5. The lifting apparatus of claim 2, each of said first leg and said second leg comprising:

a bracket member affixed to said first and second beam member; and a first leg portion pivotally connected to said bracket member.

6. The lifting apparatus of claim 5, said bracket member having a first aperture and a second aperture formed therein, said first beam member and said second beam member having holes formed therein in aligned pairs, each of said first and second legs further comprising:

a first pin member detachably received by a hole of said first beam member so as to extend through said first aperture of said bracket member and a hole of said second beam member.

7. The lifting apparatus of claim 6, each of said first and second legs further comprising:

a second pin member detachably received by another hole of said first beam member so as to extend through said second aperture of said bracket member and another hole of said second beam member.

8. The lifting apparatus of claim 5, each of said first leg and said second leg further comprising:

a second leg portion in telescoping relationship with said first leg portion; and a means for fixing said second leg portion to said first leg portion a desired distance from said bracket member.

9. The lifting apparatus of claim 8, said first leg portion having a plurality of openings formed therein, said second leg portion having at least one hole formed therein, said means for fixing comprising:

a pin member extending through said hole of said second leg portion and through at least one opening in said first leg portion.

10. The lifting apparatus of claim 8, said first leg portion being a square tubular member, said second leg portion being a square tubular member having a cross-section of a different area than a cross-section of said first leg portion, one of said first and second leg portions being slidably received within the other of said first and second leg portions.

11. The lifting apparatus of claim 1, said foot member of said first and second legs comprising:

an angle bar affixed to an end of the leg opposite said beam assembly, said angle bar extending transverse to a longitudinal axis of the leg.

12. The lifting apparatus of claim 11, said angle bar having a bottom surface with a plurality of holes formed in spaced relationship therein, said lifting apparatus further comprising:

at least one stabilizer pin extending through said hole in said angle bar so as to engage an underlying surface.

13. The lifting apparatus of claim 1, said lifting means comprising:

a winch having a handle extending outwardly therefrom, said winch having said cable extending around a sheave therein, said handle rotatable so as to reel said cable outwardly or inwardly.

14. The lifting apparatus of claim 13, said winch being mounted on a base member, said base member being threadedly secured to a top surface of said beam assembly.

15. The lifting apparatus of claim 1, said foot member of said first and second legs comprising:

an angle bar rigidly affixed to an end of the leg opposite the beam assembly; and a tube affixed to said bar, said bar and said tube extending transverse to the leg.

16. A lifting apparatus comprising:

a beam assembly;

a lifting means affixed to a surface of said beam assembly, said lifting means for lifting weighted objects toward or away from said beam assembly, said lifting means having a cable extending therefrom;

a first leg pivotally connected to one side of said lifting means on said beam assembly, said first leg pivotable between a first position in parallel relationship to said beam assembly and a second position perpendicular to said beam assembly, said first lea having a foot member affixed thereto opposite said beam assembly; and a second leg pivotally connected to an opposite side of said lifting means on said beam assembly, said second leg pivotable between a first position in parallel relationship to said beam assembly and a second position perpendicular to said beam assembly, said second leg having a foot member affixed thereto opposite said beam assembly, each of said foot members of said first and second legs comprising:

an angle bar having an upwardly extending flange; and a pivot means pivotally connected to a lower end of the leg and pivotally connected to said flange portion of said angle bar, said pivot means for moving said angle bar between a first position transverse to the leg and a second position aligned with the leg.

* * * * *